US008986059B1

(12) United States Patent
Maekawa et al.

(10) Patent No.: US 8,986,059 B1
(45) Date of Patent: Mar. 24, 2015

(54) MARINE PROPULSION DEVICE

(71) Applicant: Yamaha Hatsudoki Kabushiki Kaisha, Iwata-shi, Shizuoka (JP)

(72) Inventors: Shinya Maekawa, Shizuoka (JP); Koichi Nakayama, Shizuoka (JP); Toshio Suzuki, Shizuoka (JP); Katsumi Ochiai, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 23 days.

(21) Appl. No.: 14/053,622

(22) Filed: Oct. 15, 2013

Related U.S. Application Data

(63) Continuation of application No. 13/196,972, filed on Aug. 3, 2011, now Pat. No. 8,585,452, which is a continuation-in-part of application No. 13/081,532, filed on Apr. 7, 2011, now Pat. No. 8,469,754.

(51) Int. Cl.
*F01N 1/00* (2006.01)
*B63H 21/32* (2006.01)
*F01N 13/12* (2010.01)

(52) U.S. Cl.
CPC *F01N 1/00* (2013.01); *B63H 21/32* (2013.01); *F01N 13/12* (2013.01)
USPC ..... 440/89 H; 440/89 R; 60/323

(58) Field of Classification Search
CPC ..... B63H 21/32; B63H 20/24; B63H 20/26; F01N 3/10; F01N 13/12
USPC ..... 440/89 A, 89 H, 89 R; 60/323
See application file for complete search history.

(56) References Cited

U.S. PATENT DOCUMENTS 5,133,185 A * 7/1992 Gilbreath et al. ..... 440/89 R
5,911,610 A * 6/1999 Fujimoto ..... 440/89 R
7,698,889 B1 * 4/2010 Burk et al. ..... 60/323

OTHER PUBLICATIONS

Maekawa et al., "Marine Propulsion Device", U.S. Appl. No. 13/196,972, filed Aug. 3, 2011.
Maekawa et al., "Outboard Motor", U.S. Appl. No. 13/081,532, filed Apr. 7, 2011.

* cited by examiner

*Primary Examiner* — Lars A Olson
(74) *Attorney, Agent, or Firm* — Keating & Bennett, LLP

(57) ABSTRACT

A marine propulsion device includes an engine, an exhaust passage, a porous body, a retainer mat, and a stopper portion. The engine includes an exhaust port. The exhaust passage connects to the exhaust port. The porous body is disposed in the exhaust passage. The retainer mat covers the outside peripheral face of the porous body. The retainer mat retains the porous body. The stopper portion is disposed inside the exhaust passage. The stopper portion is disposed downstream of the porous body and spaced apart from a downstream-side end portion of the porous body. The stopper portion extends inwardly in the radial direction, past the outside peripheral surface of the porous body.

10 Claims, 14 Drawing Sheets

MARINE PROPULSION DEVICE

BACKGROUND OF THE INVENTION

1. Field of the Invention

The present invention relates to a marine propulsion device.

2. Description of the Related Art

Outboard motors and other such marine propulsion devices include exhaust passages for discharging exhaust from the engine. A honeycomb structure composed of, for example, a catalyst carrier is disposed inside the exhaust passage. In a marine propulsion device, exhaust is discharged from the engine into the water via the exhaust passage. Because of this, it is possible that the honeycomb structure may become wet due to water infiltrating from the exhaust passage. Moreover, in cases where the honeycomb structure is retained within the exhaust passage via a retainer mat, the retainer mat deteriorates if it becomes wet. If the retainer mat deteriorates, retention of the honeycomb structure becomes looser, and the honeycomb structure can no longer be retained.

According to a catalytic converter disclosed in Japanese Laid-open Patent Application No. 2003-020939, a stopper is disposed downstream from the retainer mat of the catalyst carrier, and the catalyst carrier is prevented from shifting towards the downstream end by the stopper. However, because the stopper is extended inwardly in the radial direction past the outside peripheral face of the catalyst carrier, the flow channel cross section of the catalyst carrier is constricted. For this reason, the exhaust gas cleaning performance of the catalyst is diminished.

According to an exhaust gas treatment device disclosed in Japanese Laid-open Patent Application No. 2006-070886, there is provided a stopper portion which is spaced apart from the retaining mat, and which protrudes by a protrusion amount less than the thickness of the retainer mat. Consequently, in the event that the retainer mat and the catalyst carrier move in unison, the movement of the retainer mat and the catalyst carrier can be stopped by the stopper portion. Moreover, owing to the small protrusion amount of the stopper portion, constriction of the flow channel cross section of the catalyst carrier by the stopper portion is prevented.

However, with the exhaust gas treatment device disclosed in Japanese Laid-open Patent Application No. 2006-070886, in the event that only the catalyst carrier has moved, the catalyst carrier cannot be caught by the stopper portion. It is conceivable that in a marine propulsion device, the retainer mat may become wet and deteriorate due to water infiltrating from the exhaust passage in the manner discussed above. In such a case, with the stopper portion of Japanese Laid-open Patent Application No. 2006-070886, when the retaining power of the retainer mat declines owing to deterioration, the catalyst carrier may slip out from the retainer mat.

SUMMARY OF THE INVENTION

Preferred embodiments of the present invention provide a marine propulsion device that prevents a porous body such as a honeycomb structure from slipping out from a retainer mat, without constricting a flow channel cross section of the porous body.

A marine propulsion device according to a preferred embodiment of the present invention includes an engine, an exhaust passage, a porous body, a retainer mat, and a stopper portion. The engine includes an exhaust port. The exhaust passage connects to the exhaust port. The porous body is disposed in the exhaust passage. The retainer mat covers the outside peripheral surface of the porous body. The retainer mat retains the porous body. The stopper portion is disposed inside the exhaust passage. The stopper portion is disposed downstream of the porous body, and spaced apart from a downstream-side end portion of the porous body. The stopper portion extends inwardly in the radial direction, past the outside peripheral surface of the porous body.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
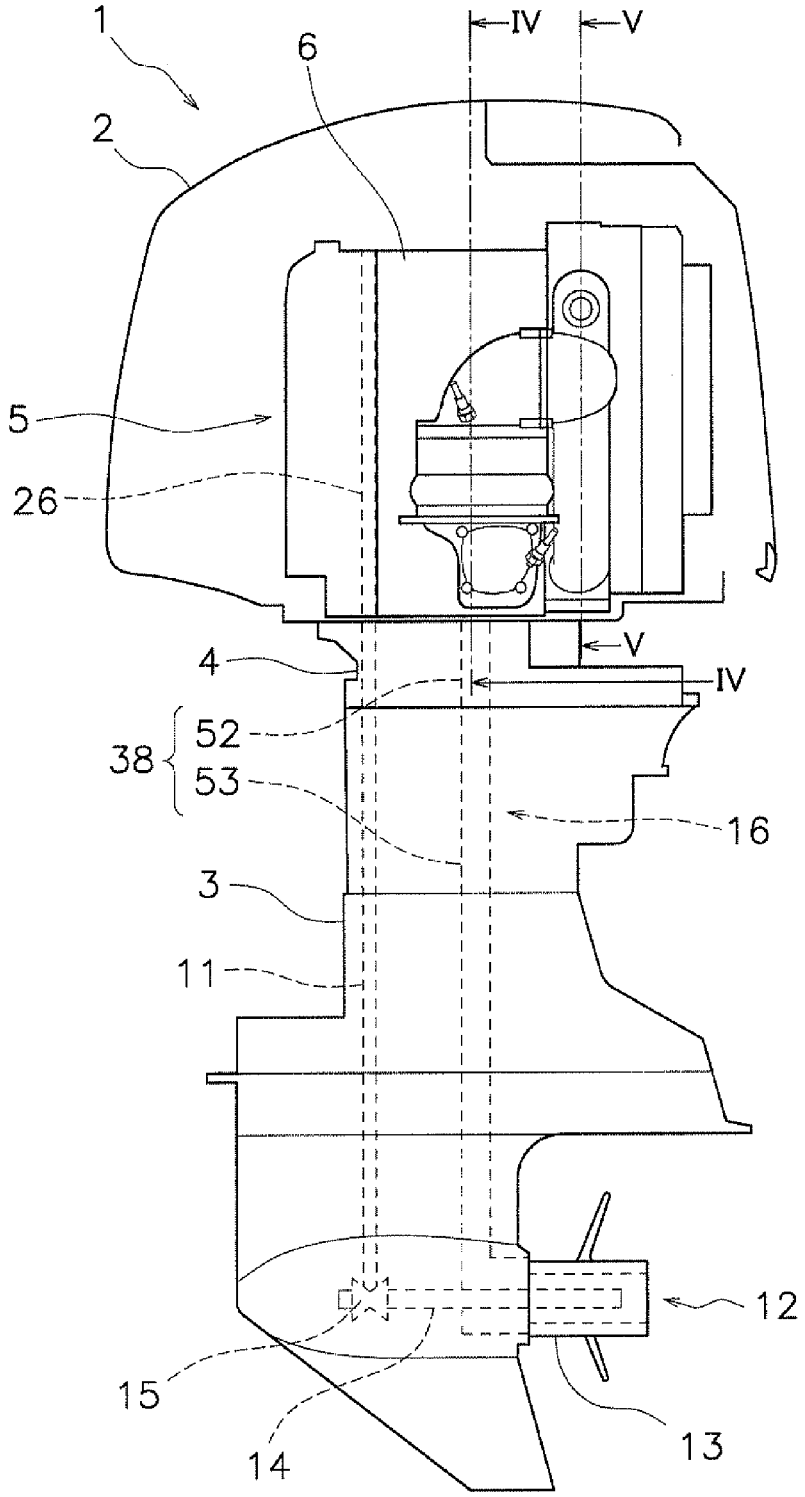
FIG. 1 is a side view of a marine propulsion device according to a preferred embodiment of the present invention.
Figure 2:
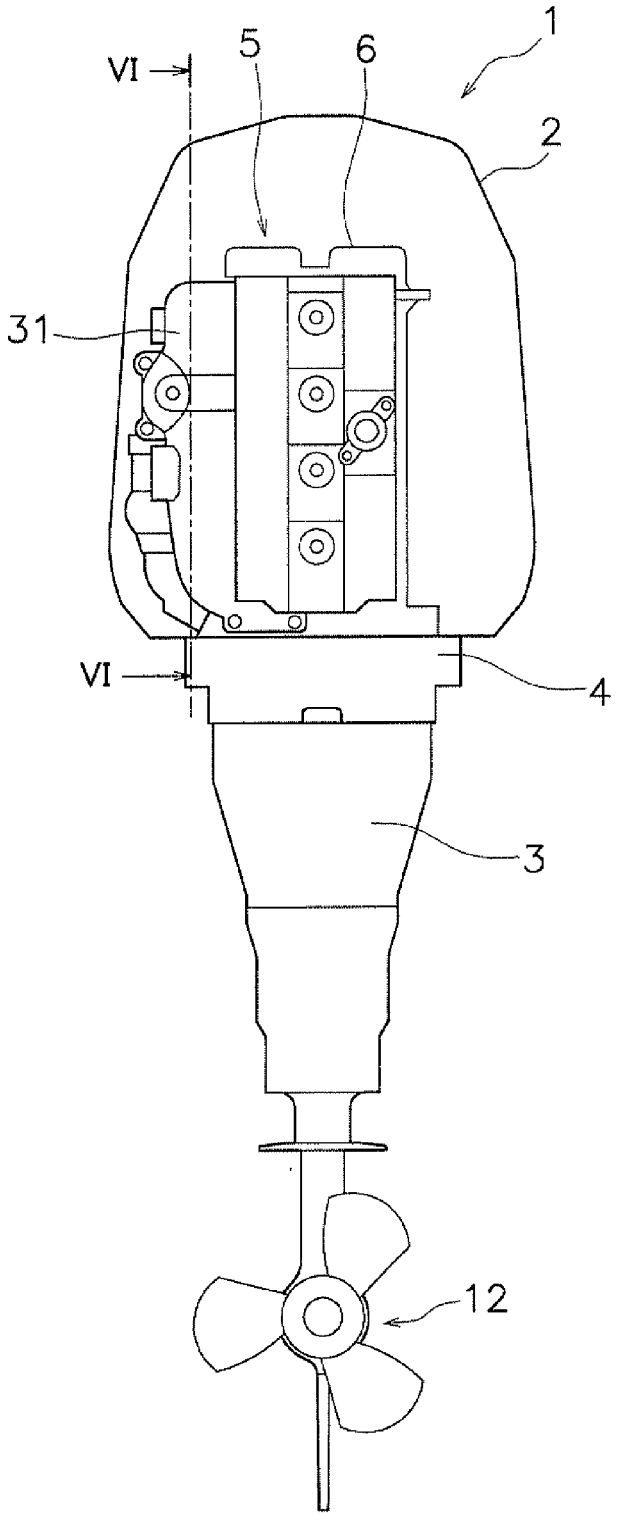
FIG. 2 is a rear view of the marine propulsion device according to a preferred embodiment of the present invention.

FIG. 1 is a side view showing a marine propulsion device 1 according to a preferred embodiment of the present invention. FIG. 2 is a rear view showing the marine propulsion device 1 according to a preferred embodiment of the present invention. While the marine propulsion device 1 according to present preferred embodiment of the present invention preferably is an outboard motor, it is possible to implement the present invention in other types of marine propulsion devices as well, such as an inboard/outboard motor, for example. As shown in FIGS. 1 and 2, the marine propulsion device 1 according to the present preferred embodiment includes an upper casing 2, a lower casing 3, an exhaust guide section 4, and an engine unit 5. For ease of understanding, the upper casing 2 is shown in cross section in FIGS. 1 and 2. The upper casing 2, the lower casing 3, and the engine unit 5 are fixed to the exhaust guide section 4.

The engine unit 5 is disposed inside the upper casing 2. Consequently, the upper casing 2 corresponds to the engine cover according to a preferred embodiment of the present invention, which covers the engine unit 5. A drive shaft 11 is disposed inside the lower casing 3, as shown in FIG. 1. The drive shaft 11 is disposed in the vertical direction inside the lower casing 3. The drive shaft 11 is connected to a crankshaft 26 of an engine 6. A propeller 12 is disposed on the bottom portion of the lower casing 3. The propeller 12 is disposed below the engine 6. The propeller 12 includes a propeller boss 13. A propeller shaft 14 is disposed inside the propeller boss 13. The propeller shaft 14 is connected to the propeller boss 13. The propeller shaft 14 is disposed in a rear to front direction. The propeller shaft 14 is connected to the bottom portion of the drive shaft 11 via a bevel gear 15.

In the marine propulsion device 1, the drive force generated by the engine 6 is transmitted to the propeller 12 via the drive shaft 11 and the propeller shaft 14. The propeller 12 is thereby rotated forward or in reverse. As a result, a propulsion force will be generated to cause the vessel equipped with the marine propulsion device 1 to move forward or backward.

The marine propulsion device 1 also includes an exhaust passage 16. The exhaust passage 16 connects to the exhaust port of the engine 6. The exhaust passage 16 is provided so as to extend from intake ports 25*a* to 25*d* (see FIG. 5) of the engine 6 through the exhaust guide section 4 and the lower casing 3 to the propeller boss 13 of the propeller 12. The exhaust passage 16 communicates with the interior of the propeller boss 13. The exhaust discharged from the engine 6 is discharged into the water from the exhaust passage 16 through the internal space of the propeller boss 13. The construction of the exhaust passage 16 will be described in detail later.

Figure 3:
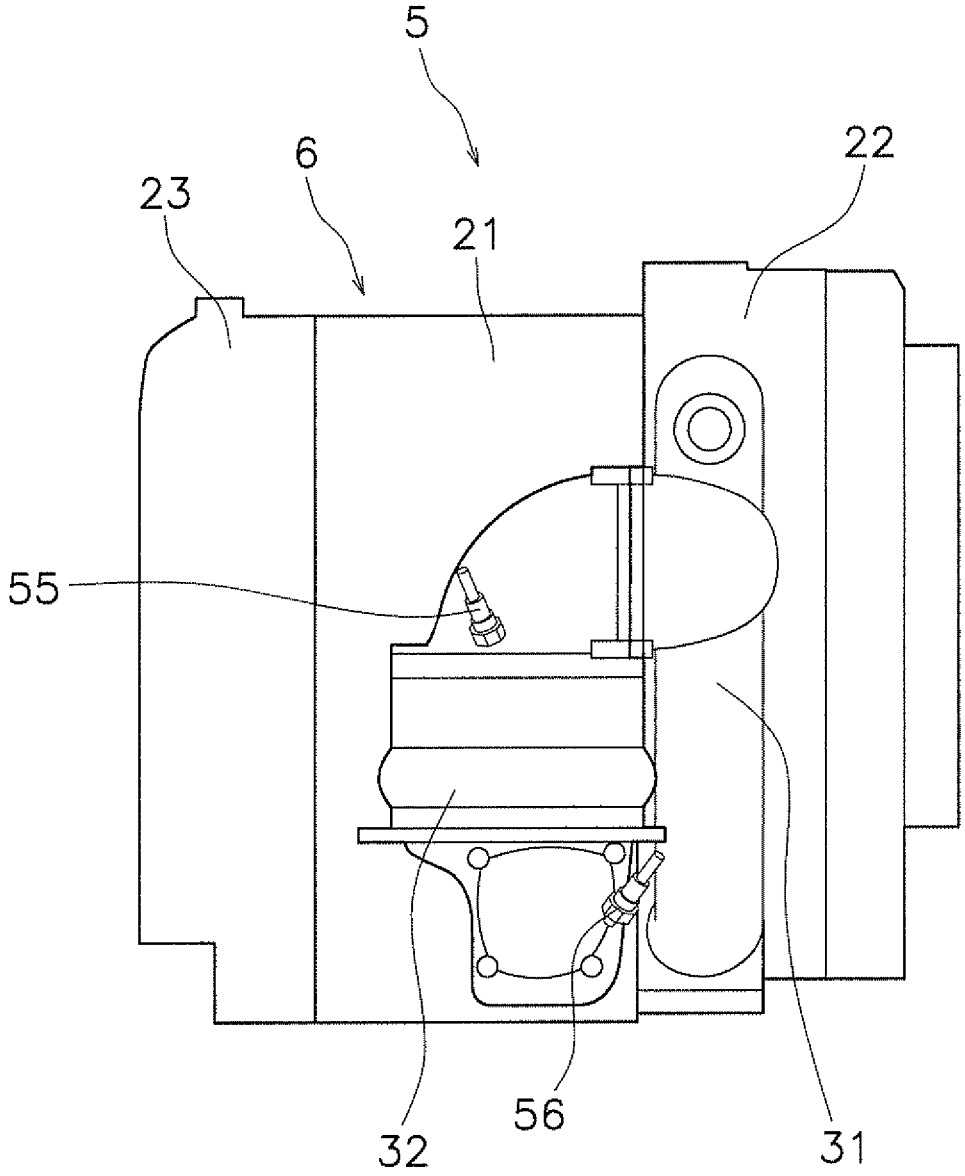
FIG. 3 is a side view of an engine unit including in a marine propulsion device according to a preferred embodiment of the present invention.

FIG. 3 is a side view of the engine unit 5. The engine unit 5 includes an engine 6, an exhaust manifold 31, and a catalyst unit 32, as shown in FIG. 3.

Figure 4:
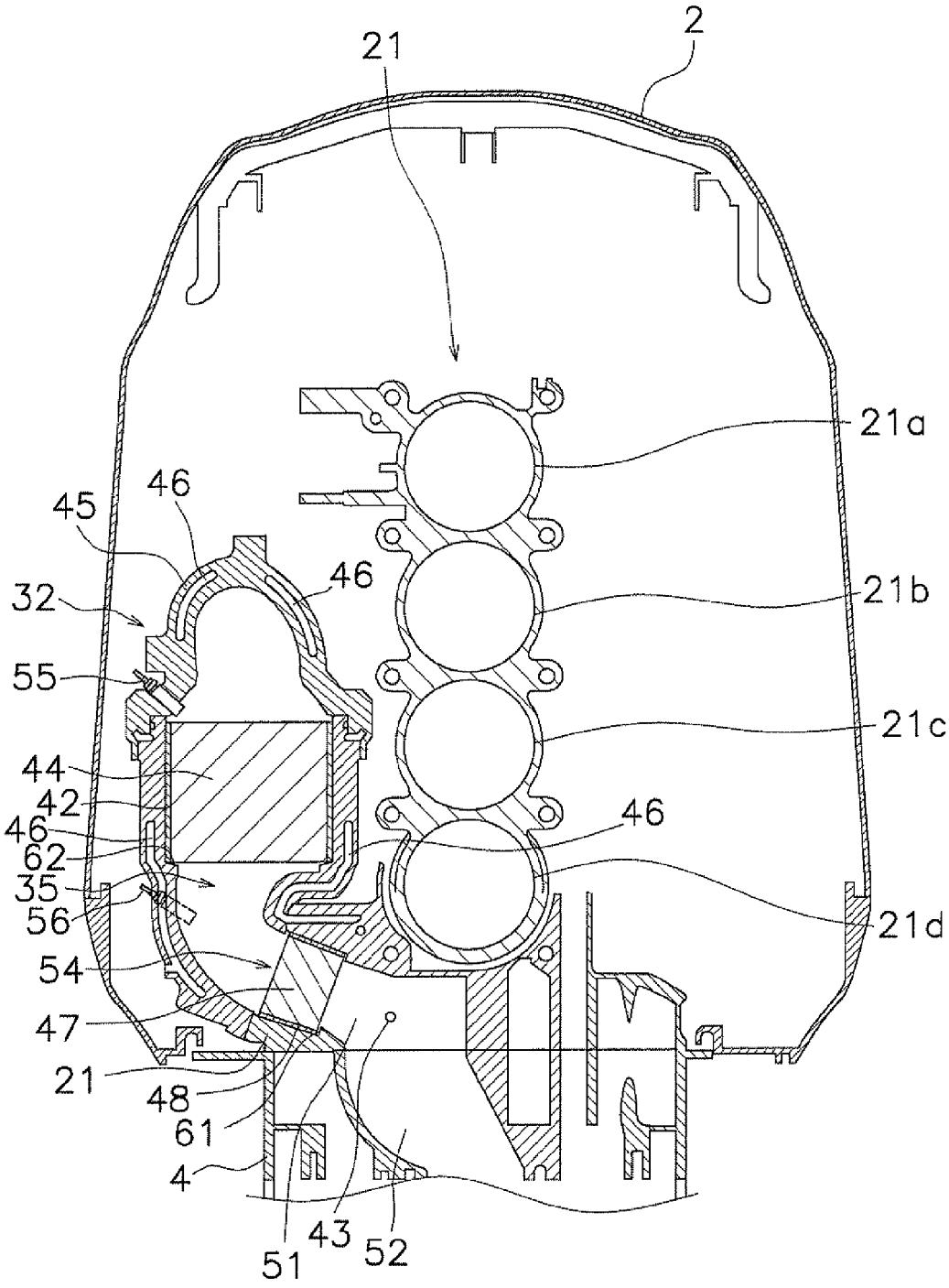
FIG. 4 is a cross-sectional view along line IV-IV in FIG. 1.

The engine 6 includes a cylinder block 21, a cylinder head 22, and a crankcase 23. The cylinder block 21 is disposed above the exhaust guide section 4 and fixed to the exhaust guide section 4. FIG. 4 is a cross-sectional view along line IV-IV in the marine propulsion device 1 in FIG. 1. As shown in FIG. 4, the cylinder block 21 preferably includes four cylinders 21*a* to 21*d*, for example. The four cylinders 21*a* to 21*d* are disposed preferably in a line in a vertical direction.

Figure 5:
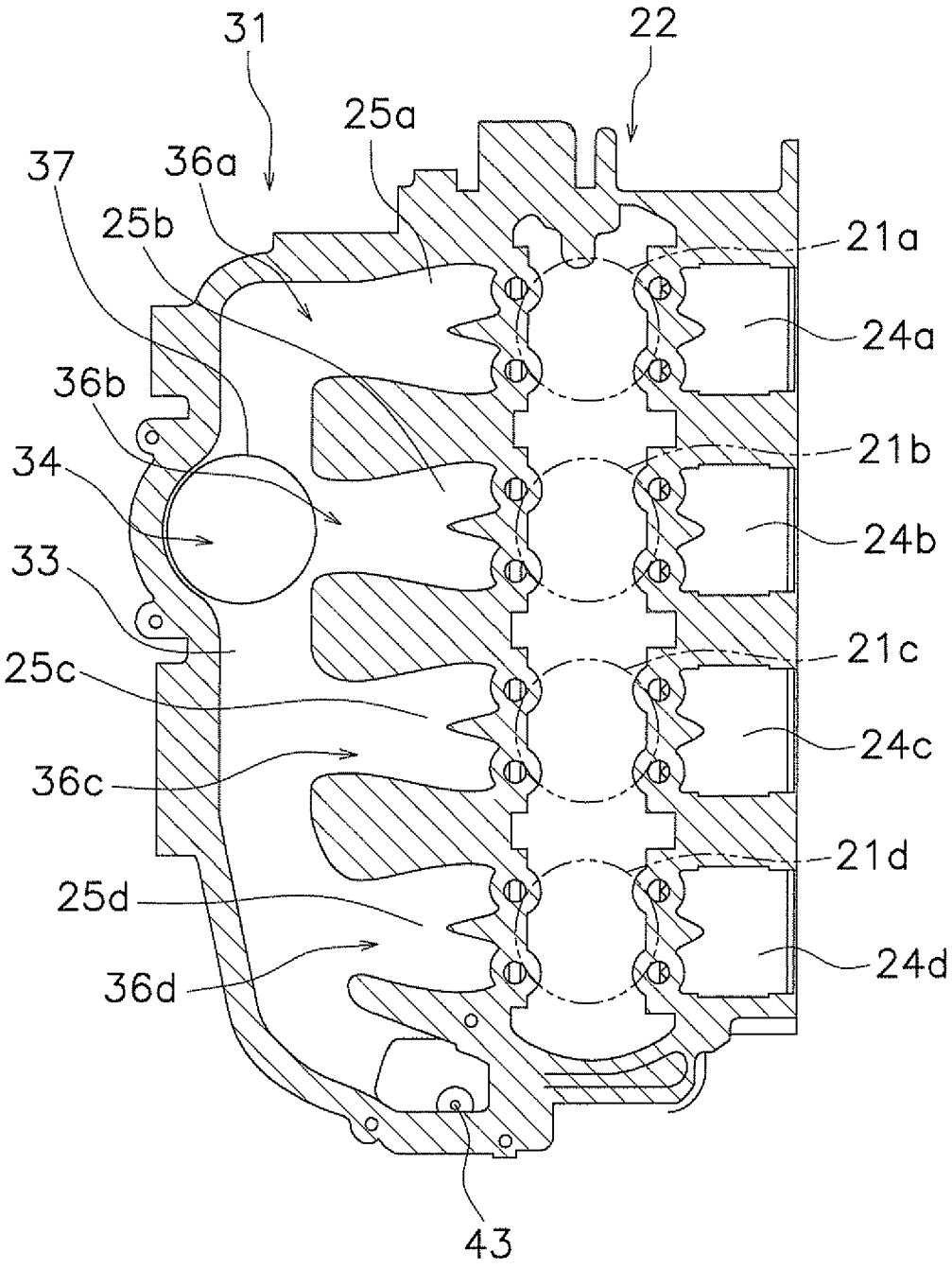
FIG. 5 is a cross-sectional view along line V-V in FIG. 1.

As shown in FIG. 3, the cylinder head 22 is disposed behind the cylinder block 21. FIG. 5 is a cross-sectional view along line V-V in the marine propulsion device 1 in FIG. 1. As shown in FIG. 5, intake ports 24*a* to 24*d* and exhaust ports 25*a* to 25*d* are disposed inside the cylinder head 22. The intake ports 24*a* to 24*d* and the exhaust ports 25*a* to 25*d* are connected to the cylinders 21*a* to 21*d*, respectively. The intake ports 24*a* to 24*d* are connected to a fuel supply system not shown in the drawing. The exhaust ports 25*a* to 25*d* extend in a lateral direction and are connected to a first passage 33 of an exhaust manifold 31, discussed below.

The crankcase 23 is disposed at the front of the cylinder block 21, as shown in FIG. 3. The crankshaft 26 (see FIG. 1) is disposed inside the crankcase 23. The crankshaft 26 extends in a vertical direction. The top end portion of the above-described driveshaft 11 is linked to the bottom end portion of the crankshaft 26. The movement of a piston (not shown) disposed inside the cylinders 21*a* to 21*d* is transmitted to the driveshaft 11 via the crankshaft 26.

The exhaust manifold 31 is disposed on the side of the cylinder head 22, as shown in FIG. 3. The exhaust manifold 31 is preferably integral with the cylinder head 22.

Figure 6:
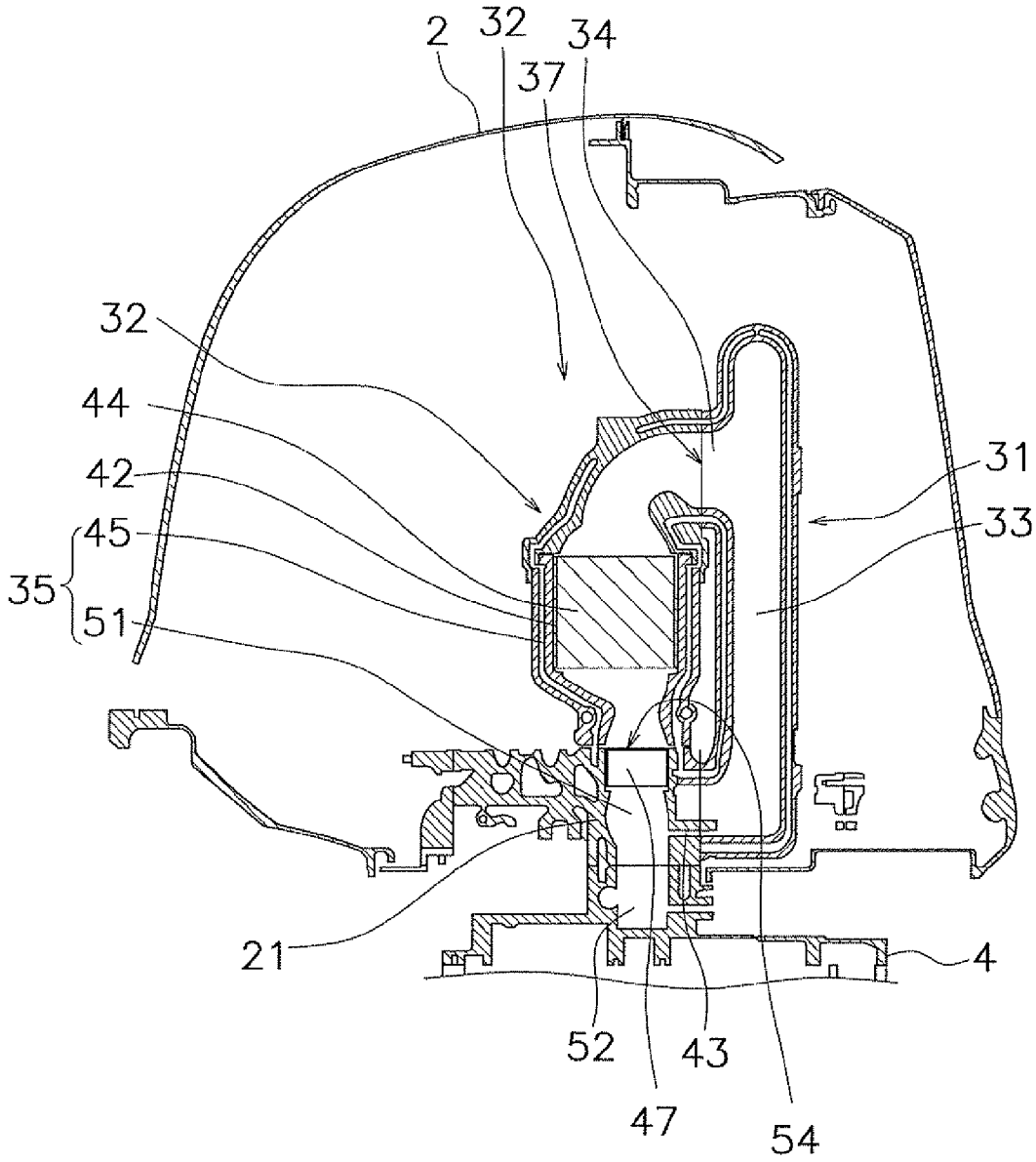
FIG. 6 is a cross-sectional view along line VI-VI in FIG. 2.

A catalyst unit 32 is preferably formed separately from the cylinder head 22 and the cylinder block 21. The catalyst unit 32 is also preferably separate from the exhaust manifold 31. The catalyst unit 32 is attached to the cylinder head 22 and the cylinder block 21. As shown in FIG. 4 and FIG. 6, the catalyst unit 32 includes a catalyst member 44, a second retainer mat 42, and a pipe 45. The catalyst member 44 is disposed inside the pipe 45. The second retainer mat 42 is wrapped onto the catalyst member 44, and contacts the catalyst member 44. The second retainer mat 42 covers the outside peripheral surface of the catalyst member 44. The outside peripheral surface of the second retainer mat 42 contacts the inside peripheral surface of the pipe 45. Because of this, the second retainer mat 42 retains the catalyst member 44 in the interior of the pipe 45. The second retainer mat 42 directly retains the catalyst member 44. The second retainer mat 42 preferably is a non-expanding mat, and is preferably composed of alumina fibers, for example. The catalyst member 44 is positioned above the bottom end portion of the cylinder 21*d*, which is the lowest-positioned of the four cylinders 21*a* to 21*d*. The pipe 45 houses the catalyst member 44. Consequently, the catalyst member 44 is disposed inside the upper casing 2. The catalyst member 44 preferably includes a catalyst carrier which supports a catalyst to clean exhaust. A three-way catalyst, for example, can be used as the catalyst. The catalyst member 44 preferably includes a cylindrical member having a honeycomb structure. The catalyst member 44 is disposed such that the flow channel is oriented in the vertical direction. In other words, the pipe 45 is disposed so that the axis line extends in the vertical direction. The catalyst member 44 is preferably made of a ceramic. The exhaust passing through the exhaust passage 16 passes through the catalyst member 44 inside the pipe 45, and is thereby cleaned.

Next, the configuration of the exhaust passage 16 is described. The exhaust passage 16, shown in FIG. 1, includes a first passage 33, a second passage 34, and a third passage 35, shown in FIG. 6, and a fourth passage 38, shown in FIG. 1. The first passage 33 and the second passage 34 are disposed inside the exhaust manifold 31, as shown in FIG. 6. The first passage 33 is connected to the above-described plurality of exhaust ports 25*a* to 25*d*. The first passage 33 is disposed on the side of the cylinder head 22 and extends in a vertical direction. A plurality of first openings 36*a* to 36*d* is formed in the first passage 33, as shown in FIG. 5, and each of the exhaust ports 25*a* to 25*d* is connected to the first passage 33 via each of the first openings 36*a* to 36*d*. The first passage 33 collects the exhaust discharged from the exhaust ports 25*a* to 25*d*.

The second passage 34 is connected to the first passage 33. As shown in FIG. 5, the portion connecting the second passage 34 and the first passage 33 is positioned between the top end of the cylinder 21*a* positioned at the uppermost portion of the plurality of cylinders 21*a* to 21*d*, and the bottom end of the cylinder 21*d* positioned at the lowermost portion of the plurality of cylinders 21*a* to 21*d*. Specifically, the vertical center portion of the portion connecting the second passage 34 and the first passage 33 is positioned higher than the vertical central portion of the first passage 33. More specifically, the portion connecting the second passage 34 and the first passage 33 is positioned at roughly the same height as the second highest cylinder 21*b* of the four cylinders 21*a* to 21*d*. The second passage 34 extends in a rear to front direction from the first passage 33. The second passage 34 is substantially parallel to the central axis lines of the cylinders 21*a* to 21*d*. In other words, the second passage 34 extends in a roughly horizontal direction. The second passage 34 also includes a second opening 37. The catalyst unit 32 is connected to the second opening 37.

The third passage 35 includes the pipe 45 of the catalyst unit 32 and a first lower passage 51, as shown in FIG. 6. The third passage 35 is connected to the second passage 34. The third passage 35 extends downward from the second passage 34. In other words, the third passage 35 corresponds to the vertical direction passage according to a preferred embodiment of the present invention, which extends in the vertical direction. Therefore, the third passage 35 is disposed substantially parallel to the crankshaft 26 (see FIG. 1). The third passage 35 is disposed on the side of the cylinder block 21. The first lower passage 51 is disposed inside the cylinder block 21. The first lower passage 51 includes a first lower opening 54. The first lower opening 54 is located on the lower portion of the lateral face of the cylinder block 21. The first lower passage 51 is connected to the catalyst unit 32 via the first lower opening 54.

A water capture member 47 is disposed downstream of the catalyst member 44 inside the third passage 35. Stated another way, the catalyst member 44 is disposed upstream from the water capture member 47. Consequently, the water capture member 47 corresponds to the first porous body according to a preferred embodiment of the present invention. The catalyst member 44 corresponds to the second porous body according to a preferred embodiment of the present invention. The water capture member 47 is disposed in the first lower passage 51, and is positioned below the catalyst member 44. The water capture member 47 preferably includes a tube-shaped member having the same honeycomb structure as the catalyst member 44. In other words, the water capture member 47 preferably is a catalyst carrier the same as the catalyst member 44, but does not support a catalyst. The water capture member 47 is preferably made of a ceramic. The water capture member 47 is disposed inside the upper casing 2. The outside diameter of the water capture member 47 is smaller than the outside diameter of the catalyst member 44. The water capture member 47 is retained by the first retainer mat 48. The first retainer mat 48 is wrapped onto the water capture member 47 and contacts the water capture member 47. The first retainer mat 48 covers the outside peripheral surface of the water capture member 47. The outside peripheral surface of the first retainer mat 48 contacts the inside peripheral surface of the first lower passage 51. Because of this, the first retainer mat 48 retains the water capture member 47 in the first lower passage 51. The first retainer mat 48 directly retains the water capture member 47. The first retainer mat 48 preferably is a non-expanding mat, and is composed of alumina fibers, for example.

The third passage 35 includes a coolant passage 46. The coolant passage 46 is disposed at a minimum surrounding the water capture member 47 and the catalyst member 44. In FIG. 4, a plurality of sections included in the coolant passage 46 are depicted as being dispersed, but these sections are connected to and in communication with one another. A coolant supplied from the coolant supply portion, not shown, circulates in the coolant passage 46.

The fourth passage 38, as shown in FIG. 1, guides the exhaust from the exhaust ports 25*a* to 25*d* below the engine 6 and discharges the exhaust to the outside via the propeller boss 13. The fourth passage 38 is positioned below the engine 6. The fourth passage 38 includes a second lower passage 52 and a third lower passage 53. The second lower passage 52 is disposed inside the exhaust guide section 4. The second lower passage 52 is connected to the first lower passage 51, as shown in FIGS. 4 and 6. The third lower passage 53 is disposed inside the lower casing 3, as shown in FIG. 1. The third lower passage 53 is connected to the second lower passage 52. The third lower passage 53 is also connected to the propeller boss 13.

In the marine propulsion device 1 according to the present preferred embodiment, the exhaust from the exhaust ports 25*a* to 25*d* of the engine 6 is collected in the first passage 33. The exhaust flows from the first passage 33 through the second passage 34 to the third passage 35. The exhaust is cleaned by being passed through the catalyst member 44 in the third passage 35. The exhaust flows from the third passage 35 to the fourth passage 38. The exhaust is sent downward from the engine 6 by being passed through the fourth passage 38. Then, the exhaust passes through the inside section of the propeller boss 13 from the fourth passage 38 and is discharged outside.

A linking passage 43 is also connected to the bottom end portion of the first passage 33, as shown in FIGS. 5 and 6. The linking passage 43 passes through the wall section of the cylinder block 21 and is linked to the first lower passage 51 as shown in FIG. 4. Therefore, the linking passage 43 links the bottom end portion of the first passage 33 and the first lower passage 51. More specifically, the linking passage 43 links the section of the first lower passage 51 positioned downstream of the water capture member 47 and the bottom end portion of the first passage 33. The linking passage 43 has a smaller cross-sectional area than the cross-sectional area of the second opening 37. Because of this, the exhaust discharged from the linking passage 43 is negligible in comparison with the second opening 37. By contrast, the condensed water generated inside the first passage 33 flows to the first lower passage 51 via the linking passage 43. Then, the condensed water passes through the fourth passage 38 and is discharged outside via the propeller boss 13. The linking passage 43 thus functions as a condensed water removal passage whereby the condensed water generated inside the first passage 33 is removed from the first passage 33.

The catalyst unit 32 also includes a first oxygen sensor 55 and a second oxygen sensor 56 arranged to detect an oxygen concentration in the exhaust, as shown in FIGS. 3 and 4. The first oxygen sensor 55 is disposed in the exhaust passage 16 upstream from the catalyst member 44. Specifically, the first oxygen sensor 55 is disposed above the catalyst member 44 in the pipe 45. The second oxygen sensor 56 is disposed below the catalyst member 44 in the pipe 45. The second oxygen sensor 56 is disposed in the exhaust passage 16 downstream from the catalyst member 44. Specifically, the second oxygen sensor 56 is disposed between the catalyst member 44 and the water capture member 47 in the exhaust passage 16. That is, the water capture member 47 is disposed between the second oxygen sensor 56 and the linking passage 43 in the exhaust passage 16. A detection signal from the first oxygen sensor 55 and the second oxygen sensor 56 is supplied to an ECU (not shown). The ECU controls the engine 6 on the basis of the detection value from the first oxygen sensor 55 and the second oxygen sensor 56.

As shown in FIG. 4, a first stopper portion 61 and a second stopper portion 62 are provided inside the exhaust passage 16. The configurations of the first stopper portion 61 and the second stopper portion 62 are described below.

Figure 7:
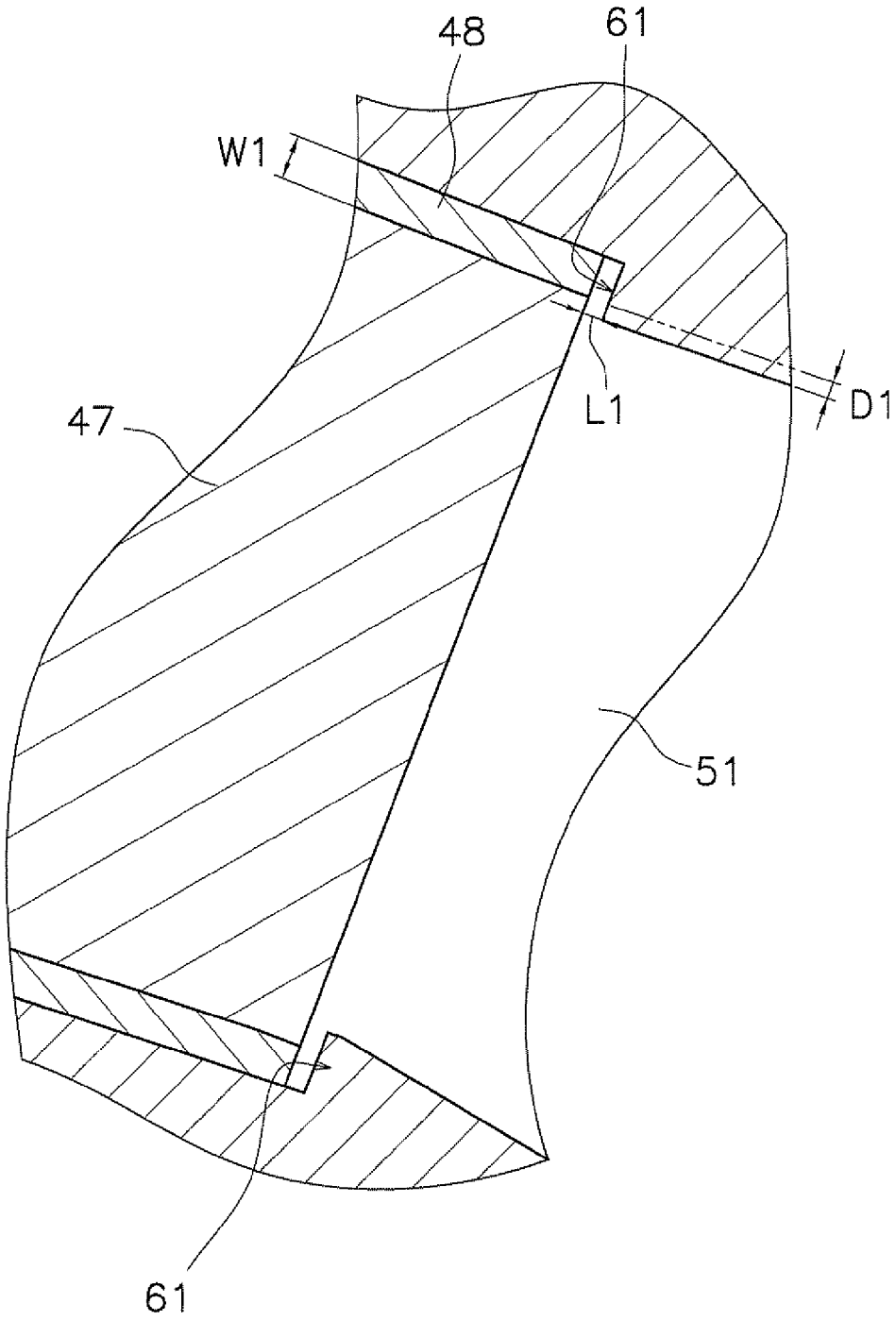
FIG. 7 is an enlarged cross-sectional view of a water capture member and surrounding structures thereof.

The first stopper portion 61 is disposed in the third passage 35, and downstream from the water capture member 47. Specifically, the first stopper portion 61 is disposed inside the first lower passage 51. FIG. 7 is an enlarged cross-sectional view showing the water capture member 47 and portion of the lower passage 51 shown in FIG. 4. The first stopper portion 61 is preferably integral with the inner surface of the first lower passage 51. The first stopper portion 61 is disposed so as to prevent downward movement of the water capture member 47. Specifically, the first stopper portion 61 is defined by an inner surface of the first lower passage 51, by extending a section thereof situated downstream from the water capture member 47 inwardly in a radial direction past the outside peripheral surface of the water capture member 47. The first stopper portion 61 is disposed downstream of the water capture member 47, and spaced apart from the downstream-side end portion of the water capture member 47. The first stopper portion 61 faces the first retainer mat 48. The first stopper portion 61 extends to a point inward in the radial direction past the outside peripheral surface of the water capture member 47. The distance L1 between the end portion at the downstream side of the water capture member 47 and the first stopper portion 61 is smaller than the thickness W1 of the first retainer mat 48. The distance L1 between the end portion at the downstream side of the water capture member 47 and the first stopper portion 61 is greater than the distance D1 in the radial direction between the inward end section in the radial direction of the first stopper portion 61 and the outside peripheral surface of the water capture member 47. Stated another way, this distance D1 is a distance for which the water capture member 47 and the first stopper portion 61 overlap in the direction of exhaust flow. In other words, the distance L1 between the end portion of the downstream side of the water capture member 47 and the first stopper portion 61 is greater than the distance D1 of overlap of the water capture member 47 and the first stopper portion 61 in the direction of exhaust flow.

Figure 8:
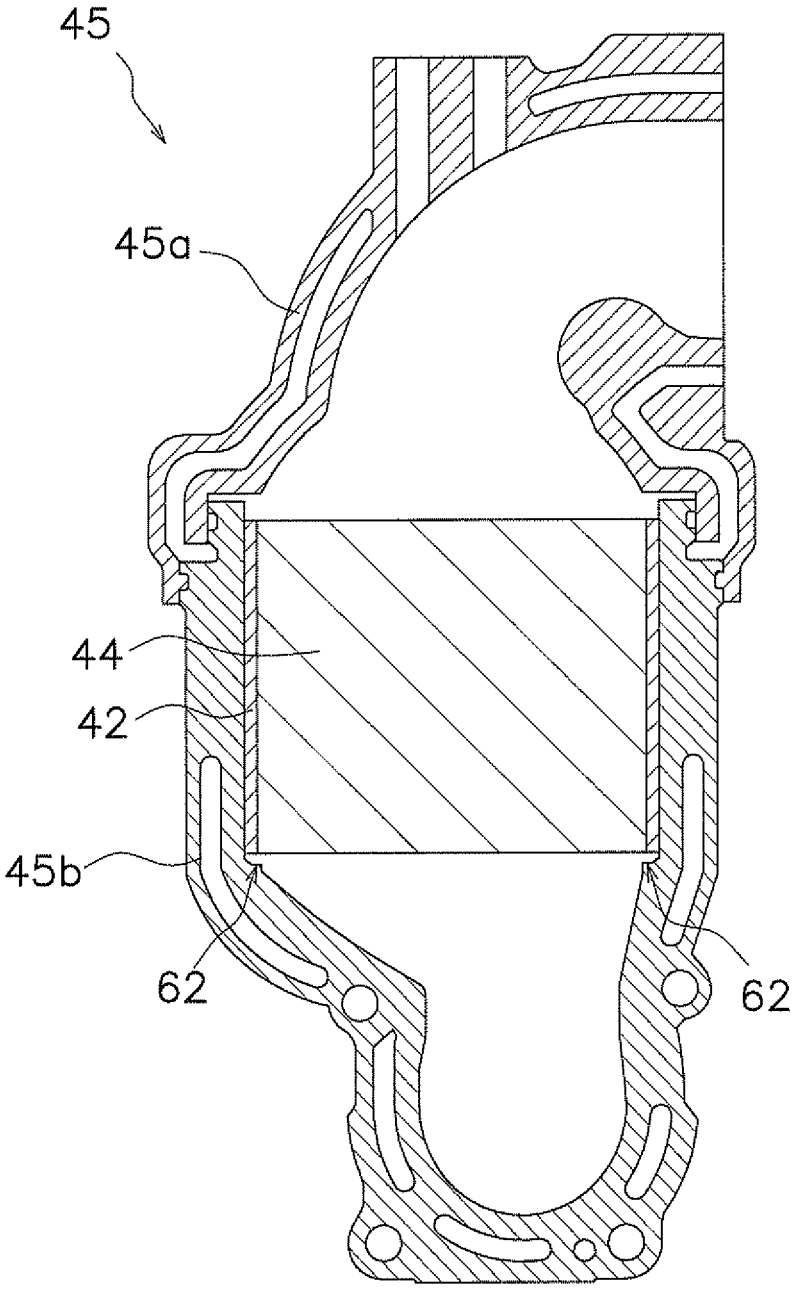
FIG. 8 is a cross-sectional view of a catalyst unit.

The second stopper portion 62 is disposed in the third passage 35, and downstream from the catalyst member 44. Specifically, the second stopper portion 62 is included in the pipe 45. FIG. 8 is a cross-sectional view of the pipe 45. The pipe 45 includes a first pipe 45*a* and a second pipe 45*b*. The second pipe 45*b* is disposed downstream of the first pipe 45*a* in the third passage 35. The second pipe 45*b* is disposed below the first pipe 45*a*. The upper end portion of the second pipe 45*b* is linked to the lower end portion of the first pipe 45*a*. The catalyst member 44 and the second retainer mat 42 are disposed inside the second pipe 45*b*. The second stopper portion 62 is preferably integral with the inner surface of the second pipe 45*b*.

Figure 9:
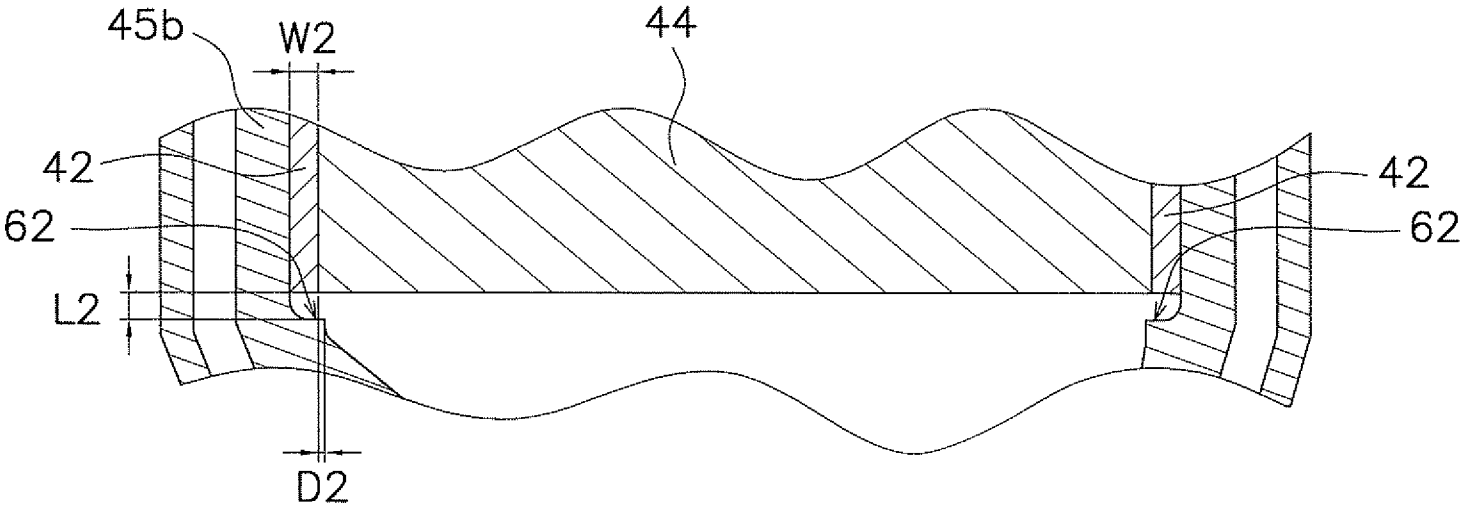
FIG. 9 is an enlarged cross-sectional view of a catalyst member and surrounding structures thereof.

FIG. 9 is an enlarged view of portion of the second pipe 45*b* and the catalyst member 44 shown in FIG. 8. The second stopper portion 62 is disposed so as to prevent downward movement of the catalyst member 44. The second stopper portion 62 is disposed below the catalyst member 44. The second stopper portion 62 is defined by an inner surface of the second pipe 45*b*, by extending a section thereof situated downstream from the catalyst member 44 inwardly in radial direction past the outside peripheral surface of the catalyst member 44. The second stopper portion 62 is disposed downstream of the catalyst member 44, and spaced apart from the downstream-side end portion of the catalyst member 44. The second stopper portion 62 faces the second retainer mat 42. The second stopper portion 62 extends to a point inward in the radial direction past the outside peripheral surface of the catalyst member 44. The distance L2 between the end portion at the downstream side of the catalyst member 44 and the second stopper portion 62 is smaller than the thickness W2 of the second retainer mat 42. The distance L2 between the end portion at the downstream side of the catalyst member 44 and the second stopper portion 62 is greater than the distance D2 in the radial direction between the inward end section in the radial direction of the second stopper portion 62 and the outside peripheral surface of the catalyst member 44. Stated another way, this distance D2 is a distance for which the catalyst member 44 and the second stopper portion 62 overlap in the direction of exhaust flow. In other words, the distance L2 between the end portion of the downstream side of the catalyst member 44 and the second stopper portion 62 is greater than the distance D2 of overlap of the catalyst member 44 and the second stopper portion 62 in the direction of exhaust flow.

The marine propulsion device 1 according to the present preferred embodiment preferably includes the following characteristics.

Because the water capture member 47 and the first stopper portion 61 are spaced apart from each other by a certain distance, constriction of the flow channel cross section of the water capture member 47 by the first stopper portion 61 is prevented. Moreover, because the first stopper portion 61 extends inwardly in the radial direction past the outside peripheral surface of the water capture member 47, even if the first retainer mat 48 has deteriorated and lost retaining power and the water capture member 47 has moved downward, the first stopper portion 61 contacts the water capture member 47. Because of this, downward movement of the water capture member 47 is restricted by the first stopper portion 61. Because of this, the water capture member 47 is prevented from slipping out from the first retainer mat 48.

If the water capture member 47 strikes against the first stopper portion 61 in the event that the water capture member 47 is forcibly inserted into the first lower passage 51 during manufacture or in other circumstances, it is possible for the water capture member 47 to be damaged. Particularly where the water capture member 47 is made of a ceramic, it is easily damaged by impact. Consequently, the present invention is even more effective where the water capture member 47 is made of a ceramic. Also, if the water capture member 47 is made of a ceramic, the lighter weight as compared with a water capture member 47 made of metal helps to prevent the water capture member 47 from dropping out.

Because the catalyst member 44 and the second stopper portion 62 are spaced apart from each other by a certain distance, constriction of the flow channel cross section of the catalyst member 44 by the second stopper portion 62 is prevented. Because of this, a decline in the exhaust gas cleaning ability due to the second stopper portion 62 is prevented.

Because the second stopper portion 62 extends inwardly in the radial direction past the outside peripheral surface of the catalyst member 44, even if the second retainer mat 42 has deteriorated and lost retaining power and the catalyst member 44 has moved downward, the second stopper portion 62 contacts the catalyst member 44. Because of this, downward movement of the catalyst member 44 is restricted. As a result, the catalyst member 44 is prevented from slipping out from the second retainer mat 42. In particular, because an engine of large size is disposed inside the upper casing 2 of the marine propulsion device 1, the layout of the catalyst unit 32 is limited. Accordingly, the catalyst member 44 is disposed such that the direction of the flow channel thereof faces in the vertical direction, like the pipe 45 of the catalyst unit 32. With this unique arrangement, in the unlikely event that the second retainer mat 42 becomes wet, the catalyst member 44 readily moves downward due to the effect of gravity. Consequently, the present preferred embodiment of the present invention is even more effective for an outboard motor that is provided with a catalyst unit 32 disposed such that the direction of the flow channel of the catalyst member 44 faces in the vertical direction.

If the catalyst member 44 strikes against the second stopper portion 62 in the event that the catalyst member 44 is forcibly inserted into the second pipe 45*b* during manufacture or in other circumstances, it is possible for the catalyst member 44 to be damaged. Particularly where the catalyst member 44 is made of a ceramic, it is easily damaged by impact. Consequently, the present invention is even more effective where the catalyst member 44 is made of a ceramic, as in the present embodiment. Also, if the catalyst member 44 is made of a ceramic, the lighter weight as compared with a catalyst member 44 made of metal helps to prevent the catalyst member 44 from dropping out.

A preferred embodiment of the present invention was described above, but the present invention is not limited to the above-described preferred embodiment and can be modified in a variety of ways within a range that does not depart from the scope of the present invention.

Figure 10:
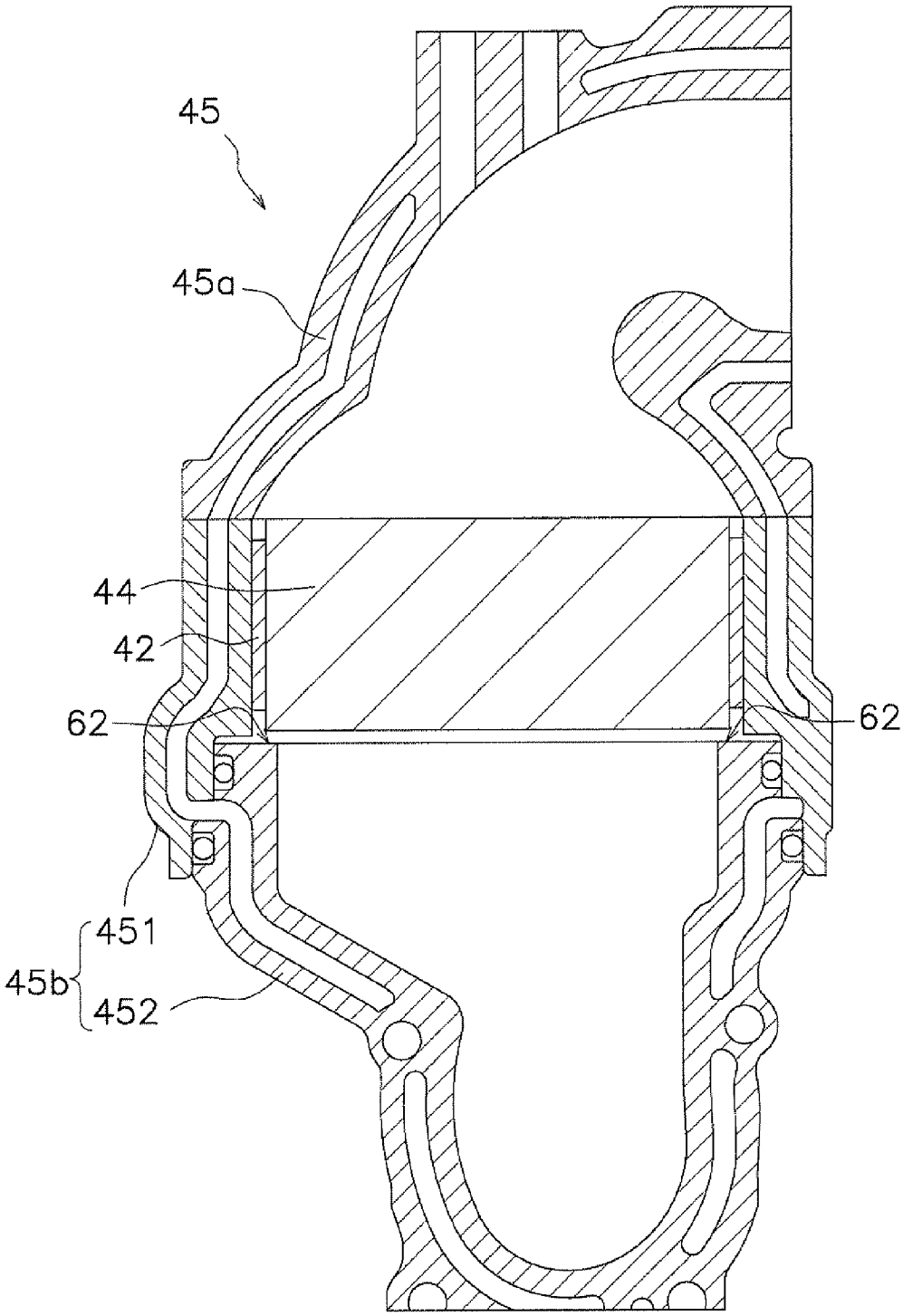
FIG. 10 is a cross-sectional view of a catalyst unit according to another preferred embodiment of the present invention.

In the preferred embodiment described above, the second stopper portion 62 is preferably integral with a pipe that retains the second stopper portion 62, namely, the second pipe 45*b*. However, the second stopper portion 62 may instead be defined by a member that is separate from the portion of the exhaust passage that retains the second stopper portion 62, as shown in FIG. 10. Specifically, the second pipe 45*b* includes an upstream second pipe 451 and a downstream second pipe 452. The upstream second pipe 451 retains the catalyst member 44 and the second retainer mat 42. In other words, the upstream second pipe 451 corresponds to the retaining portion according to a preferred embodiment of the present invention. The downstream second pipe 452 is a member that is separate from the upstream second pipe 451. The downstream second pipe 452 is situated downstream from the upstream second pipe 451 in the exhaust passage 16. Also, the downstream second pipe 452 is situated below the upstream second pipe 451. The upper end portion of the downstream second pipe 452 is linked to the lower end portion of the upstream second pipe 451. The inside diameter of the upper end portion of the downstream second pipe 452 is smaller than the outside diameter of the catalyst member 44. Because of this, the upper end portion of the downstream second pipe 452 is arranged to extend from the inside peripheral surface of the upstream second pipe 451, to a location inward in the radial direction past the outside peripheral surface of the catalyst member 44. In this way, the second stopper portion 62 is defined by the upper end portion of the downstream second pipe 452.

Figure 11:
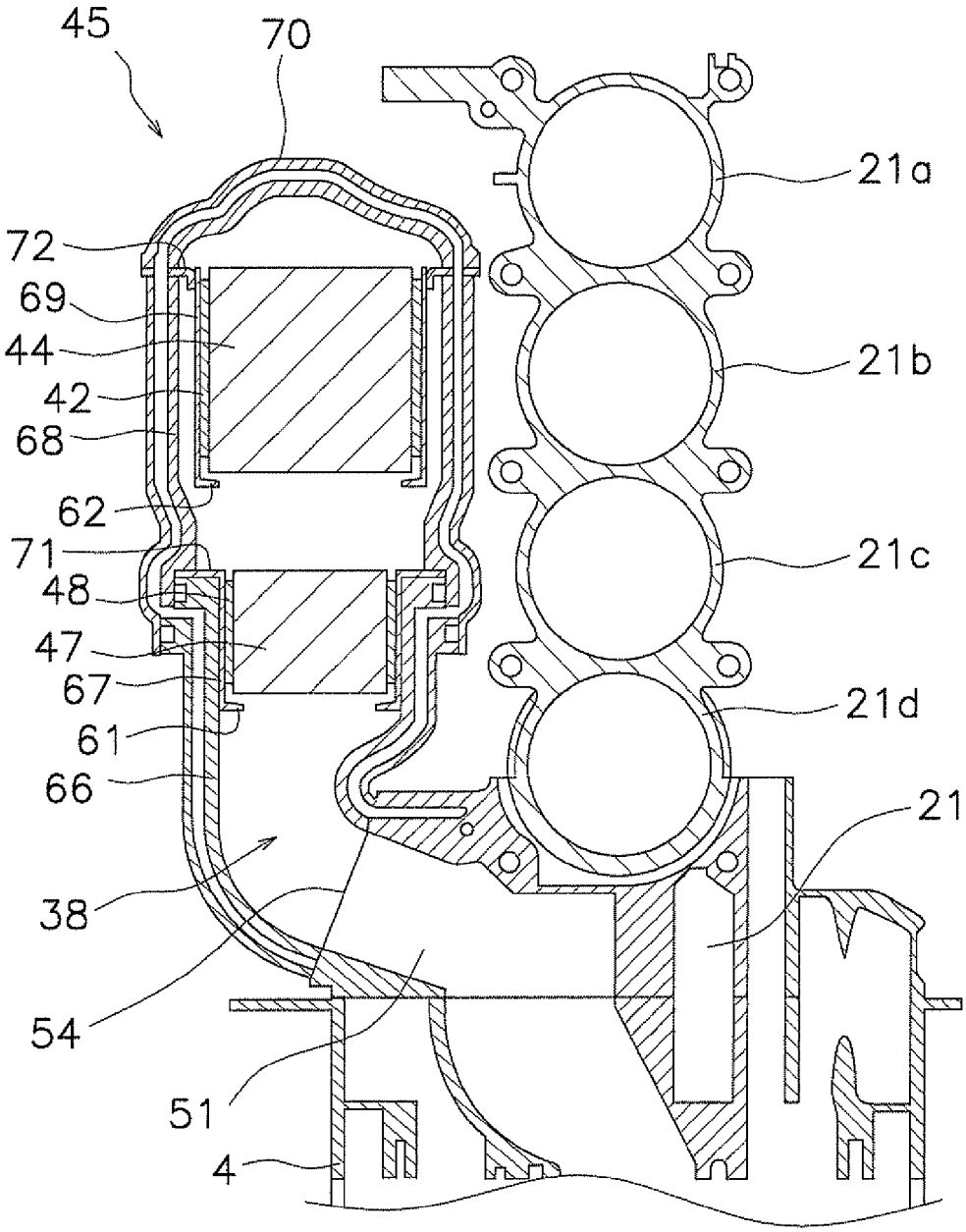
FIG. 11 is a cross-sectional view of an engine unit according to another preferred embodiment of the present invention.

The first retainer mat 48 and the water capture member 47 may be disposed inside the pipe 45 of the catalyst unit 32 as shown in FIG. 11. Also, the first stopper portion 61 may be included in a first outer tube 67 which is disposed inside a first pipe 66. The pipe 45 of the catalyst unit 32 includes the first pipe 66, a second pipe 68, and a third pipe 70. The first pipe 66, the second pipe 68, and the third pipe 70 are respectively separate members, and are linked to one another by fastening members such as bolts or the like. The first outer tube 67 is disposed inside the first pipe 66. A second outer tube 69 is disposed inside the second pipe 68.

The first pipe 66 is situated downstream of the second pipe 68. The upper end portion of the first pipe 66 is linked to the lower end portion of the second pipe 68. The upper portion of the first pipe 66 has a linear shape extending in the vertical direction. The lower portion of the first pipe 66 has a shape that curves towards a first lower opening 54. The second pipe 68 has a linear shape extending in the vertical direction. The third pipe 70 is situated above the second pipe 68. The lower end portion of the third pipe 70 is linked to the upper end portion of the second pipe 68. The third pipe 70 has a shape that curves towards the second opening 37 mentioned above.

Figure 12:
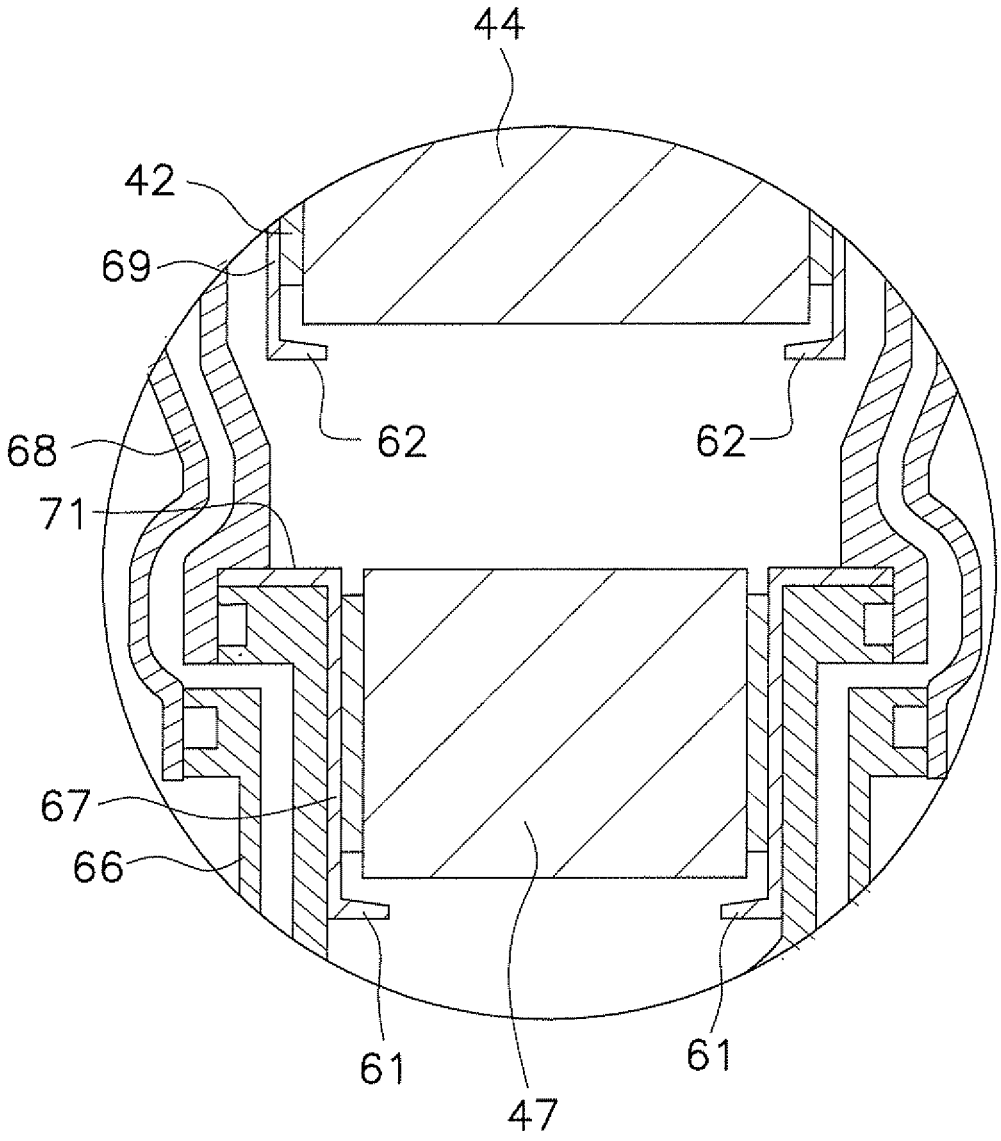
FIG. 12 is an enlarged cross-sectional view of a water capture member, a catalyst member, and surrounding structures thereof according to another preferred embodiment of the present invention.

The first outer tube 67 contacts the outside peripheral surface of the first retainer mat 48 described above, and retains the first retainer mat 48 and the water capture member 47. The first outer tube 67 has a round tube shape. The first outer tube 67 includes the first stopper portion 61. The first stopper portion 61 is situated at the lower end portion of the first outer tube 67. The first stopper portion 61 is preferably defined by a flange extending inwardly in the radial direction of the first outer tube 67. FIG. 12 is an enlarged view showing portion of the water capture member 47 and the catalyst member 44 shown in FIG. 11, and of surrounding structures thereof. The inside diameter of the first stopper portion 61 is smaller than the outside diameter of the water capture member 47. In other words, the first stopper portion 61 is formed by extending the end portion at the downstream side of the first outer tube 67 inwardly in the radial direction past the outside peripheral surface of the water capture member 47. The first outer tube 67 also includes a first flange portion 71. The first flange portion 71 is situated at the upper end portion of the first outer tube 67. The first flange portion 71 is preferably defined by a flange extending to the outside in the radial direction of the first outer tube 67. The outside diameter of the first flange portion 71 is larger than the inside diameter of the first pipe 66. By virtue of the first flange portion 71 being held between the first pipe 66 and the second pipe 68, the first retainer mat 48 and the water capture member 47 are retained inside the first pipe 66.

As shown in FIG. 11, the second outer tube 69 is disposed inside the second pipe 68. The second outer tube 69 is situated above the first outer tube 67. The second outer tube 69 contacts the outside peripheral surface of the second retainer mat 42 described above and retains the second retainer mat 42 and the catalyst member 44. The second outer tube 69 has a round tube shape. The second outer tube 69 includes the second stopper portion 62. The second stopper portion 62 is situated at the lower end portion of the second outer tube 69. The second stopper portion 62 is preferably defined by a flange extending inwardly in the radial direction of the second outer tube 69. As shown in FIG. 12, the inside diameter of the second stopper portion 62 is smaller than the outside diameter of the catalyst member 44. In other words, the second stopper portion 62 is formed by extending the end portion at the downstream side of the second outer tube 69 inwardly in the radial direction past the outside peripheral surface of the catalyst member 44. Also, as shown in FIG. 11, the second outer tube 69 includes a second flange portion 72. The second flange portion 72 is situated at the upper end portion of the second outer tube 69. The second flange portion 72 is preferably defined by a flange extending to the outside in the radial direction of the second outer tube 69. The outside diameter of the second flange portion 72 is larger than the inside diameter of the second pipe 68. By virtue of the second flange portion 72 being held between the second pipe 68 and the third pipe 70, the second retainer mat 42 and the catalyst member 44 are retained inside the second pipe 68.

Even where the water capture member 47 is disposed inside the first lower passage 51 as in the preferred embodiment described above, the water capture member 47 and the first retainer mat 48 may be retained by the first outer tube 67 which includes the first stopper portion 61, as shown in FIG. 12.

Figure 13:
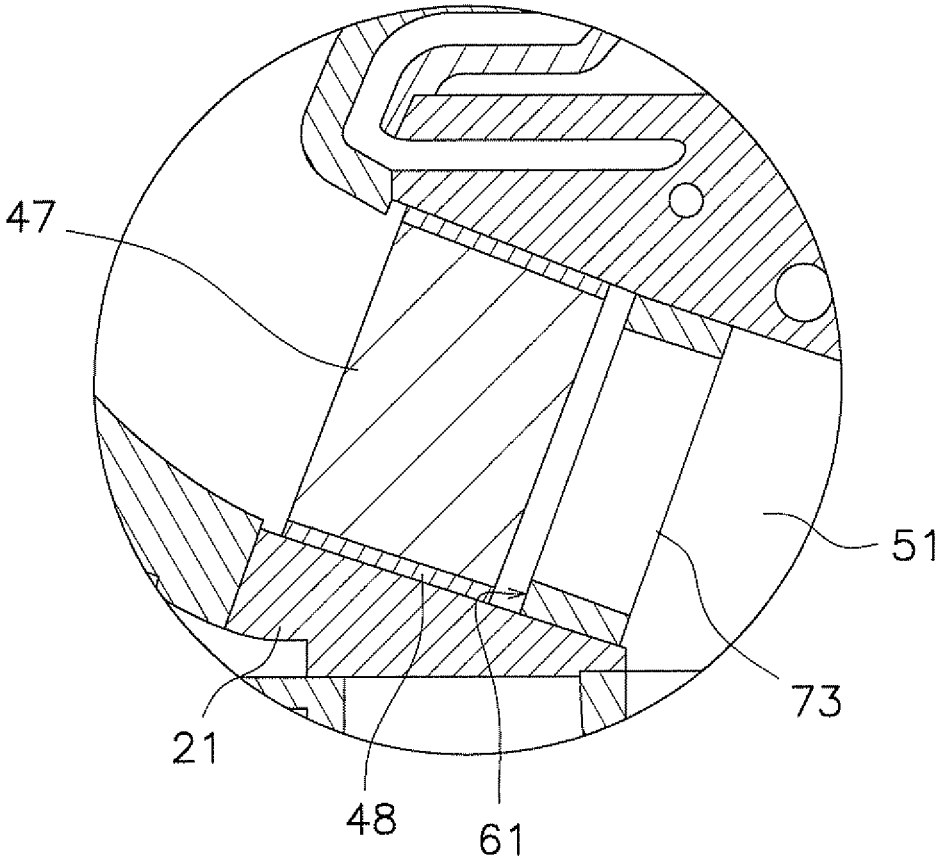
FIG. 13 is an enlarged cross-sectional view of a water capture member and surrounding structures thereof according to another preferred embodiment of the present invention.

The first stopper portion 61 may also be defined by a pipe 73 separate from the first lower passage 51, as shown in FIG. 13. The pipe 73 is disposed downstream of the water capture member 47. The pipe 73 has an inside diameter smaller than the outside diameter of the water capture member 47. The second stopper portion 62 may also be defined by a pipe that, like the pipe 73 that defines the first stopper portion 61, is separate from the pipe 45.

In the preferred embodiment described above, the water capture member 47 does not support a catalyst, but a water capture member having a catalyst supported thereon may be provided. In the preferred embodiment described above, both the first stopper portion 61 and the second stopper portion 62 are preferably provided in the exhaust passage 16, but optionally, only one may be provided. However, of the water capture member 47 and the catalyst member 44, the water capture member 47, which is situated downstream, is more likely to become wet. Because of this, it is preferable to provide the first stopper portion 61 at least downstream of the water capture member 47.

The catalyst member 44 is not limited to being made of a ceramic as in the preferred embodiments described above; a metal one is also acceptable, for example. However, from the standpoint of lighter weight, it is preferable for the catalyst member 44 to be made of a ceramic. Also, the water capture member 47 is not limited to being made of a ceramic as in the preferred embodiments described above; a metal one is also acceptable, for example. However, from the standpoint of lighter weight, it is preferable for the water capture member 47 to be made of a ceramic.

The catalyst member 44 is not limited to a honeycomb structure as in the preferred embodiments described above; a porous body including openings through which exhaust may pass is acceptable, for example. The water capture member 47 is not limited to a honeycomb structure as in the preferred embodiments described above; a porous body including openings through which exhaust may pass is acceptable, for example.

Figure 14:
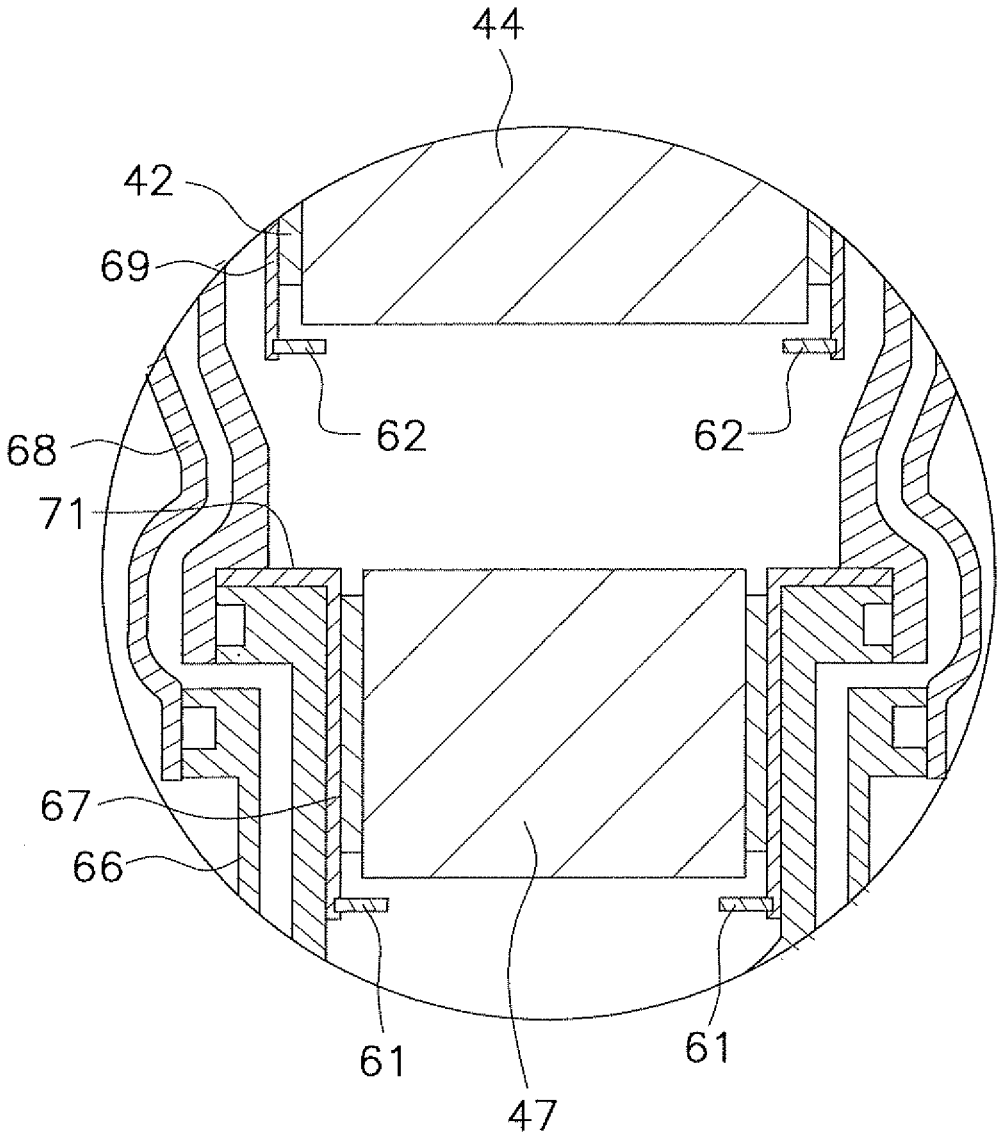
FIG. 14 is an enlarged cross-sectional view of a water capture member, a catalyst member, and surrounding structures thereof according to another preferred embodiment of the present invention.

The first stopper portion 61 may be defined by a member separate from the first outer tube 67, as shown in FIG. 14. The first stopper portion 61 is attached to the downstream-side end portion of the first outer tube 67. A circlip, for example, can be used as the first stopper portion 61. The second stopper portion 62 may be defined by a member separate from the second outer tube 69. The second stopper portion 62 is attached to the downstream-side end portion of the second outer tube 69. A circlip, for example, can be used as the stopper portion 62.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

an engine including an exhaust port;

an exhaust passage connected to the exhaust port;

a porous body disposed in the exhaust passage; and a retainer mat arranged to retain the porous body and cover an outside peripheral surface of the porous body; wherein the exhaust passage includes a stopper portion disposed upstream of the porous body, spaced apart from an upstream-side end portion of the porous body, and extending inwardly in a radial direction past the outside peripheral surface of the porous body; and the exhaust passage includes a coolant passage disposed surrounding the porous body.

2. The marine propulsion device according to claim 1, wherein the engine includes a crankshaft extending in a vertical direction, a drive shaft connected to the crankshaft, a propeller shaft connected to the drive shaft, and a propeller connected to the propeller shaft.

3. The marine propulsion device according to claim 2, wherein the propeller includes a propeller boss to which the propeller shaft is connected, and the exhaust passage communicates with an interior of the propeller boss.

4. The marine propulsion device according to claim 1, wherein the porous body is made of a ceramic.

5. The marine propulsion device according to claim 1, wherein the porous body is a catalyst carrier.

6. The marine propulsion device according to claim 1, wherein the marine propulsion device is an outboard motor and includes an engine cover covering the engine;

the engine includes a crankshaft extending in a vertical direction; and the porous body is disposed inside the engine cover.

7. The marine propulsion device according to claim 6, wherein the porous body is disposed such that a flow channel is oriented in the vertical direction.

8. The marine propulsion device according to claim 7, wherein the exhaust passage includes a vertical direction passage which extends in the vertical direction; and the porous body is disposed inside the vertical direction passage.

9. The marine propulsion device according to claim 1, wherein the stopper portion faces the retainer mat.

10. The marine propulsion device according to claim 1, wherein the porous body has a honeycomb structure.

* * * * *